US005442930A

United States Patent [19]

Stieferman

[11] Patent Number: 5,442,930

[45] Date of Patent: Aug. 22, 1995

[54] ONE STEP REFRIGERANT RECOVER/RECYCLE AND RECLAIM UNIT

[76] Inventor: Dale M. Stieferman, 4720 Leandra La., Jefferson City, Mo. 65109

[21] Appl. No.: 141,279

[22] Filed: Oct. 22, 1993

[51] Int. Cl.[6] ..... F25B 47/00

[52] U.S. Cl. ..... 62/85; 62/77; 62/292; 62/149; 62/475

[58] Field of Search ..... 62/77, 85, 149, 292, 62/475

[56] References Cited

U.S. PATENT DOCUMENTS

| | | | |
|---|---|---|---|
| 3,232,070 | 2/1966 | Sparano | 62/149 |
| 3,237,420 | 3/1966 | Mulholland | 62/77 |
| 4,285,206 | 8/1981 | Koser | 62/126 |
| 4,476,688 | 10/1989 | Goddard | 62/149 |
| 4,539,817 | 9/1985 | Staggs et al. | 62/149 |
| 4,554,792 | 11/1985 | Margulefsky et al. | 62/77 |
| 4,646,527 | 3/1987 | Taylor | 62/85 |
| 4,766,733 | 8/1988 | Scuderi | 62/77 |
| 4,768,347 | 9/1988 | Manz et al. | 62/149 |
| 4,805,414 | 2/1989 | Manz et al. | 62/292 |
| 4,809,515 | 3/1989 | Houwink | 62/149 |
| 4,856,289 | 8/1989 | Lofland | 62/149 |
| 4,856,290 | 8/1989 | Rodda | 62/149 |
| 4,862,699 | 9/1989 | Lounis | 62/84 |
| 4,903,499 | 2/1990 | Merritt | 62/149 |
| 4,939,903 | 7/1990 | Goddard | 62/77 |
| 4,939,905 | 7/1990 | Manz | 62/77 |
| 4,969,495 | 11/1990 | Grant | 141/98 |
| 4,981,020 | 1/1991 | Scuderi | 62/77 |
| 4,988,413 | 3/1991 | Sato et al. | 62/149 |
| 4,993,461 | 2/1991 | Yamane | 141/231 |
| 5,020,331 | 6/1991 | Michny | 62/77 |
| 5,022,230 | 6/1991 | Todack | 62/77 |
| 5,050,388 | 9/1991 | Packo | 62/77 |
| 5,067,327 | 11/1991 | Leblanc | 62/292 |
| 5,090,211 | 2/1992 | Peters | 62/149 |
| 5,090,212 | 2/1992 | Keltner et al. | 62/149 |
| 5,090,215 | 2/1992 | Giesler et al. | 62/475 |
| 5,094,087 | 3/1992 | Gramkow | 62/292 |
| 5,094,277 | 3/1992 | Grant | 141/98 |
| 5,095,713 | 3/1992 | Laukhuf et al. | 62/149 |
| 5,097,667 | 3/1992 | Gramkow | 62/77 |
| 5,099,653 | 3/1992 | Major et al. | 62/149 |
| 5,123,259 | 6/1992 | Morgan, Sr. | 62/292 |
| 5,127,232 | 7/1992 | Paige et al. | 62/77 |
| 5,146,761 | 9/1992 | Cavanaugh et al. | 62/149 |
| 5,161,385 | 11/1992 | Schumacher | 62/127 |
| 5,167,126 | 12/1992 | Cartwright | 62/129 |
| 5,172,562 | 12/1992 | Manz et al. | 62/149 |
| 5,193,351 | 3/1993 | Laukhuf et al. | 62/77 |
| 5,195,333 | 3/1993 | Van Steenburgh, Jr. | 62/292 |
| 5,201,188 | 4/1993 | Sakuma | 62/149 |
| 5,231,842 | 8/1993 | Manz et al. | 62/77 |

OTHER PUBLICATIONS

"Update" in globe-Tech Newsletter regarding Robinson Airtech, Inc. recovery/recycling units.

*Primary Examiner*—John M. Sollecito
*Attorney, Agent, or Firm*—Standley & Gilcrest

[57] ABSTRACT

A device that recovers, recycles and/or reclaims refrigerant for air conditioning systems, refrigeration systems, heat exchange systems and other similar systems. The device vaporizes the refrigerant first and then removes oil and other contaminants from the refrigerant in a separate separator.

23 Claims, 2 Drawing Sheets

ONE STEP REFRIGERANT RECOVER/RECYCLE AND RECLAIM UNIT

BACKGROUND OF THE INVENTION

The present invention relates to a device that recovers, recycles and/or reclaims refrigerant for air conditioning systems, refrigeration systems, heat exchange systems and other similar systems.

One major source of fluorocarbons (including CFC, HCFC, or HFC) being emitted into the atmosphere is medium to high pressure refrigerants (containing fluorocarbons having a saturation vapor pressure at 70° F. at 60–250 psi) such as 12, 22, 500, 502, 134A, MP39, MP66, HP62, HP81, AZ20, and AZ50, which are used in many different types of air conditioning, refrigeration and other systems. Many members in the scientific community have determined that the ozone layer in the earth's atmosphere is being depleted in part by the emission of flourocarbons. Thus, efforts have been made to reduce the amount of flourocarbons being emitted into the atmosphere.

Due to these scientific findings and the political climate, there is an increasing demand for a device that will recover refrigerant without allowing the fluorocarbons to be emitted into the atmosphere, as well as to filter, clean and recycle the refrigerant. Such a device halts the waste of used refrigerant and stops the emission of fluorocarbons into the atmosphere.

There are a number of known devices available. However, it is not known in the art to vaporize the refrigerant first and then remove any oil and other contaminants from the refrigerant in a separate separator. Most of the related systems have filtering capabilities. Those systems having oil separators use the method of capturing the oil in the liquid phase within an oil separator by withdrawing the vapor. In these systems, some of the oil and other contaminants are carried out of the oil separator in the vapor. Many of these systems are not easily transportable to all places where one might use such a system.

SUMMARY OF THE INVENTION

A device is provided to recover, recycle, and reclaim refrigerant from a source from which refrigerant is recoverable. In particular, there is provided at least one input port in which liquid refrigerant enters the device. This input port may be connected using hoses and other connections normally used during the service of an air conditioning unit for example. The refrigerant enters the input port and is directed by suitable piping or tubing into a vaporizing means, which may be a heat chamber or other suitable vaporizing device. As the liquid refrigerant enters the vaporizing means, the refrigerant "boils" and turns into a vapor. The vapor refrigerant leaves the vaporizing means and enters a first separator, such as a contaminant separator that separates contaminants including oil and acids from the refrigerant.

In the first separator, the contaminants including oil and acids, fall to the bottom and the vapor rises to the top. The vapor exits through a port located at the top of the separator leaving the contaminants at the bottom. The refrigerant then enters the compressor which compresses the refrigerant to a relatively high pressure. The refrigerant leaves the compressor and enters a condenser that cools the refrigerant. At least some of the refrigerant is then in a liquid state after being cooled and the refrigerant flows to the output port. From here, the refrigerant may flow to a refrigerant recovery bottle/-tank or back into the source of the original used refrigerant.

The invention may further include a vapor input port in association with the first separator. Also, the invention may include a strainer and an expansion valve located between the liquid input port and the vaporizing means. The vaporizing means may further include a thermostat and use heating means to vaporize the liquid refrigerant.

The invention may further include a first filtering means to filter contaminants from the refrigerant while the refrigerant is in the vapor state and a second filtering means to filter contaminants from the refrigerant while the refrigerant is in the liquid state. The invention may further include a second separator, pressure regulating means, and refrigerant storage means.

This device allows a user to recover, recycle and clean refrigerant so that the refrigerant can be reused. The present invention is a solution to the problem of allowing refrigerant to escape into the atmosphere. Thus, the user will not have to buy all new refrigerant which saves the user money as well as not contributing to the depletion of the ozone layer in the atmosphere. New government regulations require the recovery of this refrigerant and do not allow this refrigerant to escape into the atmosphere, so this system allows the user to comply with these regulations. This system not only recovers the refrigerant but also cleans the refrigerant so that it can be used again.

These and other objects and features of the present invention will be better understood and appreciated from the following detailed description of the main embodiment thereof, selected for purposes of illustration, and shown in the accompanying drawings.

DETAILED DESCRIPTION OF PREFERRED EMBODIMENTS

Figure 1:
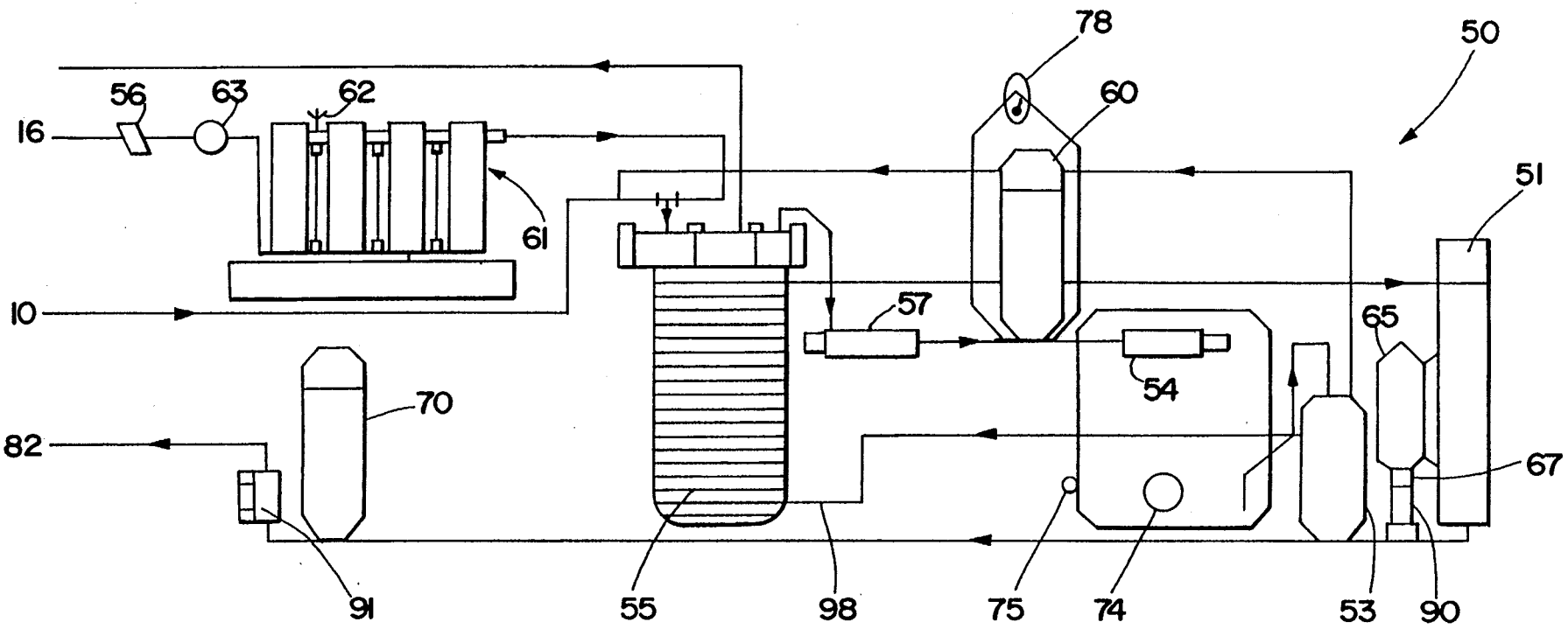
FIG. 1 is a schematic diagram of the refrigerant recovery, recycling, and recharging device in accordance with the present invention.
Figure 2:
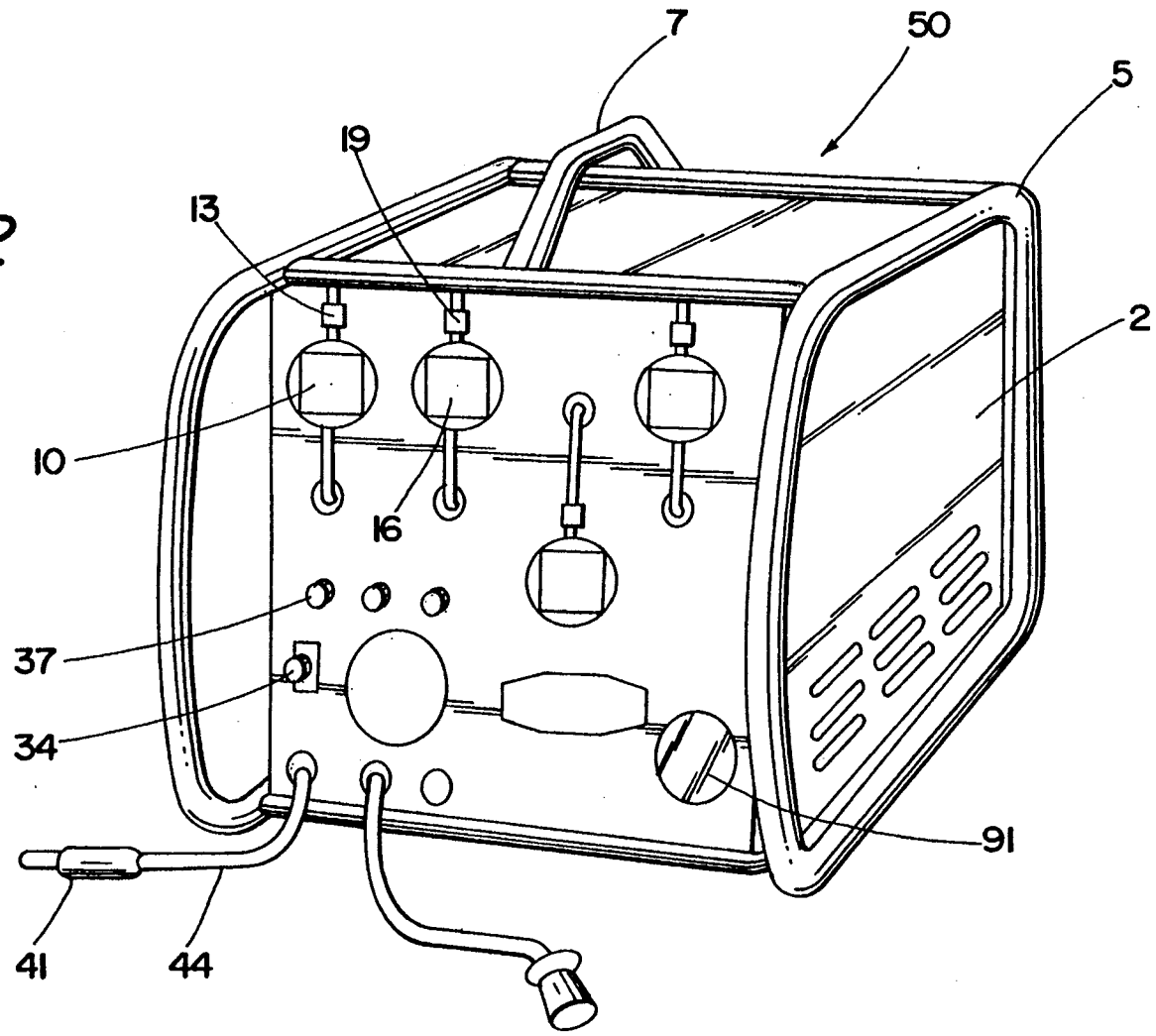
FIG. 2 is a perspective view of the device of the present invention.

Referring now to the drawings, FIG. 1 illustrates a preferred embodiment of a refrigerant recovery, recycling and reclaiming device 50 of the present invention. FIG. 2 is a view of the control panel of the device 50. The device 50 provides high efficiency filtering and cleaning of the refrigerant as it is being recovered. The device 50 filters and cleans used refrigerant in one step, so in normal use, there will be a minimal amount of contaminants in the refrigerant as it leaves the device 50.

The device 50 can be used to recover refrigerant in the vapor and/or liquid phase. As such, there is provided a vapor input port 13 having a vapor input valve 10 and a liquid input port 19 having a liquid input valve 16. The device 50 is typically connected to a source from which refrigerant is recoverable by a service manifold gauge and hose combination. The hoses are typically connected to the liquid input port 19 and/or the vapor input port 13.

In device 50, liquid refrigerant is processed differently than vapor refrigerant until the refrigerant enters the first separator 55. After the refrigerant enters the first separator 55, the refrigerant is processed the same throughout the rest of the device 50.

As vapor refrigerant enters the device, via the vapor input valve 10, the vapor refrigerant is directed by suitable piping or tubing into the first separator 55. As liquid refrigerant enters the device 50, via the liquid input valve 16, the liquid refrigerant passes through a strainer 56. The strainer 56 removes any solid particles in the liquid refrigerant. The liquid refrigerant then passes through an expansion valve 63 that lowers the pressure of the liquid refrigerant substantially and, in conjunction with heating by the vaporizing heat chamber(s) 61, the liquid refrigerant begins to boil or vaporize. As the liquid refrigerant boils, the liquid is substantially converted to a vapor. The vaporizing heat chamber(s) 61 is controlled by a thermostat 62 so the heating of the liquid refrigerant is done accurately and efficiently.

The vapor leaves the heat chamber(s) 61 and combines with any refrigerant vapor entering from the vapor input valve 16. This combined vapor refrigerant is processed the same throughout the rest of the device 50 so the remainder of the device 50 is applicable to either vapor or liquid refrigerants entering the device 50.

The refrigerant, which is now mostly a vapor, enters the first separator 55. Any liquid that enters the separator 55 generally drops to the bottom of the separator 55 and "boils" off. The boiling of the refrigerant creates a vapor which joins other vapor in the separator 55. There is a baffle inside the separator 55 that allows the vapor to leave the separator 55 while not allowing contaminants such as oil and acids to escape with the refrigerant. The output of the separator 55 is in association with the input of a compressor 54 which causes a differential in pressure within the separator 55. This differential in pressure draws the vapor out of the separator 55.

The refrigerant exits the separator 55 and enters a pressure regulator 57. The pressure regulator 57 prevents excess pressure from entering the compressor 54 so the compressor 54 can operate at safe pressure levels.

The refrigerant passes through the pressure regulator 57 and enters a filter 60. In this preferred embodiment, filter 60 is a suction line filter primarily used for removing acids from the vapor refrigerant. This suction line filter may contain a molecular sieve. There are advantages to filtering out any remaining contaminants in the refrigerant while it is in a vapor state. A pressure differential gauge 78 may be connected across the filter 60 to monitor the filter 60 and determine if there is a pressure drop across the filter 60 which indicates filter clogging.

The refrigerant passes through the filter 60 and enters the compressor 54. The compressor 54 may be a standard compressor known in the art. Generally, the compressor is a reciprocal compression system having a motor crank piston assembly and suction discharge valve. The compressor 54 compresses the refrigerant vapor to a relatively high pressure. Typically, compressors are lubricated by oil contained within the refrigerant. In this case, the refrigerant entering the compressor 54 contains only small amounts of oil, if any, because the oil is removed by the separator 55. Therefore, the compressor requires an internal lubricant. Typically, 18–20 ounces of oil are added to the compressor. During use, this oil becomes deteriorated and contaminated and requires replacement periodically. In this preferred embodiment, the compressor may have a sight glass 74 which allows the user to visually determine the level of oil in the compressor 54. In this preferred embodiment, the oil may be changed in the compressor 54 by opening an oil drain 75 whereby oil is discharged through the oil drain 75 due to some pressure inside of the compressor 54. New oil can then be added through the oil drain 75.

The refrigerant exits the compressor 54 and enters a second separator 53 that removes any remaining oil and other contaminants. As the oil collects to a preselected volume in the second separator 53, a float sensor allows the excess oil and other contaminants to flow into the first separator 55.

The refrigerant then exits the second separator 53 and enters a heat exchanger 98 which is in heat exchange contact with the first separator 55. For example, the heat exchanger may consist of tubing that wraps around the first separator 55 or may be located inside the first separator 55 or both. Other methods and equipment to exchange heat may be utilized without departing from the inventive concept as illustrated and described in the preferred embodiment. The heat exchanger 98 warms first separator 55 and cools the refrigerant vapor. The somewhat cooled and condensed refrigerant exits the heat exchanger 98 and enters an air cooled condenser 51. Generally, the air cooled condenser 51 is made from standard items in the art consisting of a condenser 51, motor 90 and motor driven fan 65. The fan 65 may be controlled by a thermostat 67 which provides air to the condenser 51 when needed. Other methods and equipment to condense the refrigerant may be utilized without departing from the inventive concept as illustrated and described in the preferred embodiment.

The refrigerant is preferably sub-cooled and condensed to a liquid in the condenser 51. The refrigerant, now in the liquid state, flows through a second filter 70. The second filter 70 provides additional and secondary filtering for any contaminants that may have passed through the device 50. The filter 70 is preferably a liquid line filter used primarily to remove moisture from the refrigerant.

In this preferred embodiment, the refrigerant exits the filter 70 and enters a visual moisture indicator/sight glass 91 which enables a user to determine if there is more than a preselected level of moisture in the refrigerant such that the refrigerant is not suitable for reuse. The refrigerant then exits the visual moisture indicator/sight glass 91 and exits the device 50 via output port 82. The refrigerant may flow to a refrigerant recovery bottle/tank or back into the source of the original used refrigerant.

The device 50 may also include a full level indicator switch within the storage bottle/tank. The full level indicator switch may be a spring assisted float that operates a sealed micro switch, as the liquid reaches the full level. The full level indicator switch is electrically connected to the device 50 via an electrical cord 44 and electrical plug 41. When the bottle/tank reaches the full level, the switch operates to shut down the device 50. This prevents over-filling and over-pressurizing the refrigerant storage bottle/tank.

Means other than the preferred embodiment of the full level indicator switch, may be utilized without departing from the inventive concept. An alternative may be a scale having a pressure sensitive switch.

The device 50 may also have a high pressure control and a low pressure control. The high pressure control monitors the output of the compressor 54 and will shut down the device 50 if for some reason a high pressure is developed. When the device 50 is shut down for high pressure, a high pressure visual indicator light 37 is lighted to alert the operator. The high pressure control automatically resets so that once the high pressure has been eliminated from the device 50, the device 50 will restart.

The low pressure control monitors the output of the first separator 55. When a low pressure is encountered, the low pressure control shuts down the device 50 and a low pressure visual indicator light 34 is lighted to alert the operator. This low pressure control provides a means to shut down the device 50 when all the refrigerant has been recovered from a source of refrigerant. The low pressure control automatically resets itself so that the device 50 will turn itself back on when the pressure increases in the device 50.

The device 50 may be used with other equipment and may be subject to rough handling. Therefore, a cage 5 is designed to protect the device 50 from rough handling. The cage 5 also acts as a roll bar to protect the control panel and housing 2. Typically, the cage 5 is made from tubular aluminum, but other materials could be substituted. The housing 2 also comprises handle 7.

Having described the invention in detail, those skilled in the art will appreciate that modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims and their equivalents.

What is claimed is:

1. A refrigerant recovery device, comprising:

at least one input port which may be connected to a source from which liquid refrigerant is recoverable;

a vaporizer for vaporizing the liquid refrigerant, said vaporizer having an input and an output, said vaporizer input in fluid communication with said input port;

a first separator having an input and an output, said first separator input in fluid communication with said output of said vaporizer;

a compressor having an input and an output, said compressor input in fluid communication with said output of said first separator;

a heat exchanger having an input and an output, said heat exchanger input in fluid communication with said output of said compressor, said heat exchanger being in heat exchange contact with said first separator;

a condenser having an input and an output, said condenser input in fluid communication with said output of said heat exchanger; and an output port in fluid communication with said output of said condensing means.

2. The device of claim 1, wherein said device further comprises a vapor input port in fluid communication with said first separator.

3. The device of claim 1, wherein said device further comprises a vapor filter having an input and an output, said vapor filter input in fluid communication with said output of said first separator and said vapor filter output in fluid communication with said input of said compressor.

4. The device of claim 1, wherein said device further comprises second separator having an input in fluid communication with said output of said compressor and said second separator output in fluid communication with said heat exchanger.

5. The device of claim 1, wherein said device further comprises a liquid filter having an input and an output, said liquid filter input in fluid communication with said output of said condenser and said liquid filter output in fluid communication with said output port.

6. The device of claim 1, wherein said device further comprises a pressure regulator having an input and an output, said pressure regulator input in fluid communication with said output of said first separator and said pressure regulator output in fluid communication with said input of said compressor.

7. The device of claim 1, wherein said device further comprises a strainer having an input and an output, said strainer input in fluid communication with said input port and said output of said strainer in fluid communication with said input of said vaporizer.

8. The device of claim 1, wherein said device further comprises an expansion valve having an input and an output, said expansion valve input in fluid communication with said input port and said expansion valve output in fluid communication with said input of said vaporizer.

9. The device of claim 1, wherein said vaporizer comprises a heater.

10. The device of claim 9, wherein said heater comprises at least one heat chamber.

11. The device of claim 1, wherein vaporizer further comprises a thermostat.

12. The device of claim 3, wherein said device further comprises a pressure differential gauge connected across said vapor filter.

13. The device of claim 4, wherein said second separator comprises a float sensor, said float sensor being capable of monitoring the volume of oil and other contaminants in said second separator such that whenever a preselected volume is encountered, the excess oil and other contaminants are allowed to return to said first separator.

14. The device of claim 1, further comprising a fan in association with said condenser.

15. The device of claim 1, further comprising refrigerant storage tank in fluid communication with said output port.

16. The device of claim 15, wherein said refrigerant storage tank further comprises a spring assisted float contained within said storage tank; and a sealed micro switch, said micro switch being operated by said float, and further being electrically connected to said refrigerant recovery device to terminate the recovery operation when operated upon by said float.

17. A method for recovering and cleaning refrigerant, comprising the following steps in the sequence set forth:

drawing liquid refrigerant into at least one evaporator;

vaporizing the liquid refrigerant by raising the temperature in said evaporator;

combining vapor refrigerant with the vaporized liquid refrigerant into a common refrigerant stream;

separating contaminants from the refrigerant with a first separator;

compressing the refrigerant;

reducing the temperature of the refrigerant such that at least some of the refrigerant is in a liquid state using a heat exchanger in heat exchange contact with said separator; and discharging the refrigerant.

18. The method of claim 17, further comprising the step of drawing the liquid refrigerant through a strainer before drawing the refrigerant into said evaporator.

19. The method of claim 17, further comprising the step of separating contaminants from the refrigerant with a second separator after compressing the refrigerant.

20. The method of claim 17, further comprising the step of filtering contaminants from the refrigerant after said first separator.

21. The method of claim 17, further comprising the step of storing the recycled refrigerant in a refrigerant storage tank after discharging.

22. A refrigerant recovery device, comprising:

a liquid input port which may be connected to a source from which refrigerant is recoverable;

a vapor input port which may be connected to a source from which refrigerant is recoverable;

a vaporizer for vaporizing liquid refrigerant, said vaporizer having an input and an output, said vaporizer input in fluid communication with said liquid input port;

a first separator having an input and an output, said first separator input in fluid communication with said output of said vaporizer and said vapor input port;

a first filter having an input and an output, said first filter input in fluid communication with said output of said first separator;

a compressor having an input and an output, said compressor input in fluid communication with said output of said first filter;

a second separator having an input and an output, said second separator input in fluid communication with said output of said compressor;

a heat exchanger having an input and an output, said heat exchanger input in fluid communication with said output of said second separator, said heat exchanger in heat exchange contact with said first separator;

a condenser having an input and an output, said condenser input in fluid communication with said output of said heat exchanger;

a second filter having an input and an output, said second filter input in fluid communication with said output of said condenser; and an output port in fluid communication with said output of said second filter.

23. The method of claim 17, further comprising the step of filtering the contaminants from the refrigerant after reducing the temperature.

* * * * *